US005255921A

United States Patent [19]

Spence

[11] Patent Number: 5,255,921

[45] Date of Patent: Oct. 26, 1993

[54] GOLF SWING TRAINING KIT

[76] Inventor: Brian M. Spence, 10 Simcoe Street East, Hamilton, Ontario, Canada, L8L 3M9

[21] Appl. No.: 909,265

[22] Filed: Jul. 6, 1992

[51] Int. Cl.[5] ..... A63B 69/36

[52] U.S. Cl. ..... 273/187 A; 434/252; 273/188 R; 273/192; 273/187 B

[58] Field of Search ..... 273/187 R, 188 R, 187 A, 273/187 B, 187.1, 186.1, 192; 435/252

[56] References Cited

U.S. PATENT DOCUMENTS

| | | | |
|---|---|---|---|
| 2,025,519 | 12/1935 | Lingg | 273/187 R |
| 2,180,170 | 11/1939 | Richards | 273/187 R |
| 2,652,251 | 9/1953 | Molinar | 273/187 R |
| 2,886,326 | 5/1959 | Olds | 273/187 R |
| 3,253,830 | 5/1966 | Laskin | 273/187 R |
| 3,343,268 | 9/1967 | Schennum | 273/187 R |
| 3,623,733 | 11/1971 | Cavanaugh | 273/188 R X |
| 3,718,330 | 2/1973 | Gariti | 273/187 R |
| 3,868,116 | 2/1975 | Ford et al. | 273/187 R X |
| 4,257,608 | 3/1981 | Funk | 273/187 R |
| 4,784,393 | 11/1988 | Williams et al. | 273/187 R |
| 5,013,044 | 5/1991 | Hesselbart | 273/187 R |
| 5,014,994 | 5/1991 | Peters | 273/187 R |
| 5,083,789 | 1/1992 | Hickson | 273/187 R |

*Primary Examiner*—George J. Marlo
*Attorney, Agent, or Firm*—Rogers & Scott

[57] ABSTRACT

The invention provides a kit for training a golfer to obtain a proper swing, the kit having a base positionable on the ground and having markings to locate the feet and ball in correct relation to a target line to a target. A backswing guide member is securable to the base at a fixed angle to indicate the direction a golf club should be pointing during a first step of a correct backswing when the golfer's wrists are substantially adjacent the leg furthest from the target. "The direction indicated by the backswing guide member is at an angle of approximately 40° to the target line facing away from the target."

20 Claims, 7 Drawing Sheets

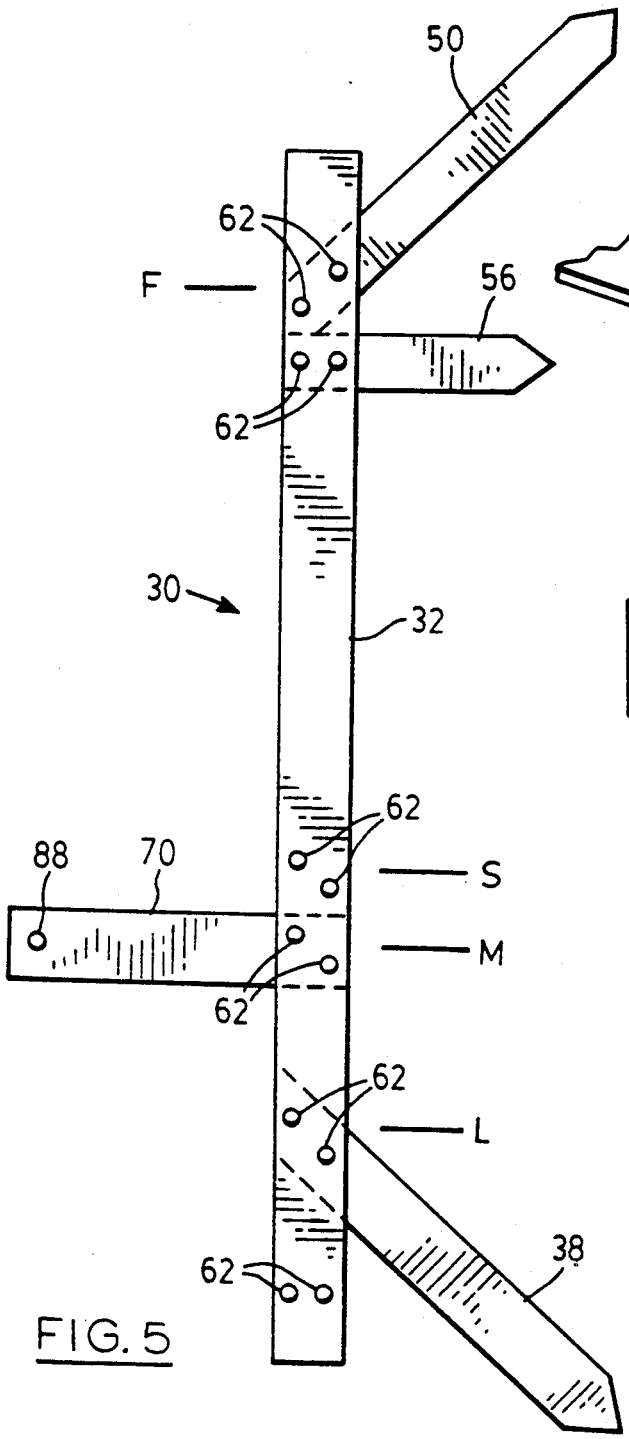
FIG. 5
FIG. 4
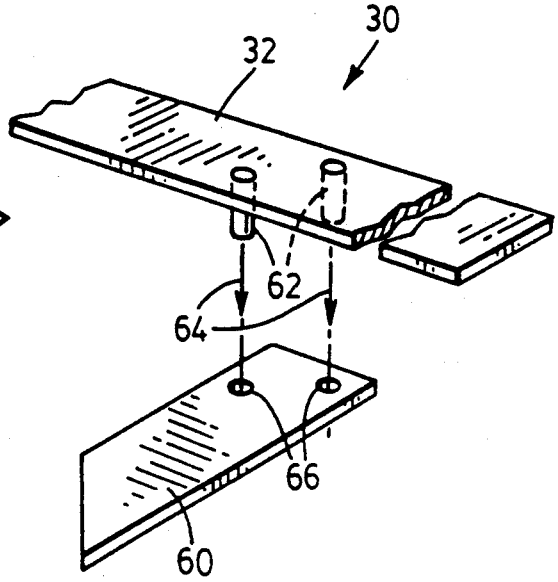

GOLF SWING TRAINING KIT

This invention relates to devices for training golfers to obtain a proper swing.

When playing golf, a proper swing is of primary importance for achieving a consistently successful golf shot. An amateur trying to learn a proper swing has several options. A golf professional can be retained which is often expensive and for some an embarrassing prospect. Books are available, but they can not physically guide a golfer through the required steps.

Thus, there is a need for an inexpensive training device that can be used in privacy at home or inconspicuously outdoors.

Prior art shows many such devices. However, none has achieved great success for various reasons, such as complicated assembly or operation. In many cases, the device has parts raised from the ground making it noticeable, again causing embarrassment. Also, prior art devices do not have all the features required to help guide the golfer through the swing.

Consequently, it is an object of this invention to provide an improved device for training a golfer to obtain a proper swing.

According to the invention there is provided a kit for training a golfer to obtain a proper swing, the kit having a base positionable on the ground and having markings to locate the feet and ball in correct relation to a target line to a target. A backswing guide member is securable to the base to indicate the direction a golf club should be pointing during a first step of a correct backswing when the golfer's wrists are substantially adjacent the leg furthest from the target.

The kit may further include a follow-through guide member securable to the base to indicate the direction a golf club should be pointing during a first step of a correct follow through swing when the golfer's wrists are substantially adjacent the leg closest to the target.

In the preferred embodiment the backswing guide member lies substantially flat on the ground. The base has markings to locate the feet when using a range of different golf clubs as well as markings to locate the feet for a fade or a draw golf shot.

A foot tilting member is securable to the base at a position to lift the outside of the foot of the leg furthest from the target. The kit may also include hip positioners which extend substantially perpendicular to the ground to indicate the permissible range of hip movement during a proper swing. A putting track member is provided for guiding a putter head to stroke substantially towards the target.

Preferably the kit is made from modular pieces which connect together and are made of plexiglass. The modular pieces are stackable on one another to fit in an elongated case.

Embodiments of the invention will now be described, by way of example, with reference to the accompanying drawings of which:

FIG. 4 is a simplified perspective assembly drawing of the foot offset member;

FIG. 5 is a view similar to FIG. 2 further showing a foot tilting member used to teach placing of the weight on the inside of the rear foot;

Figure 1:
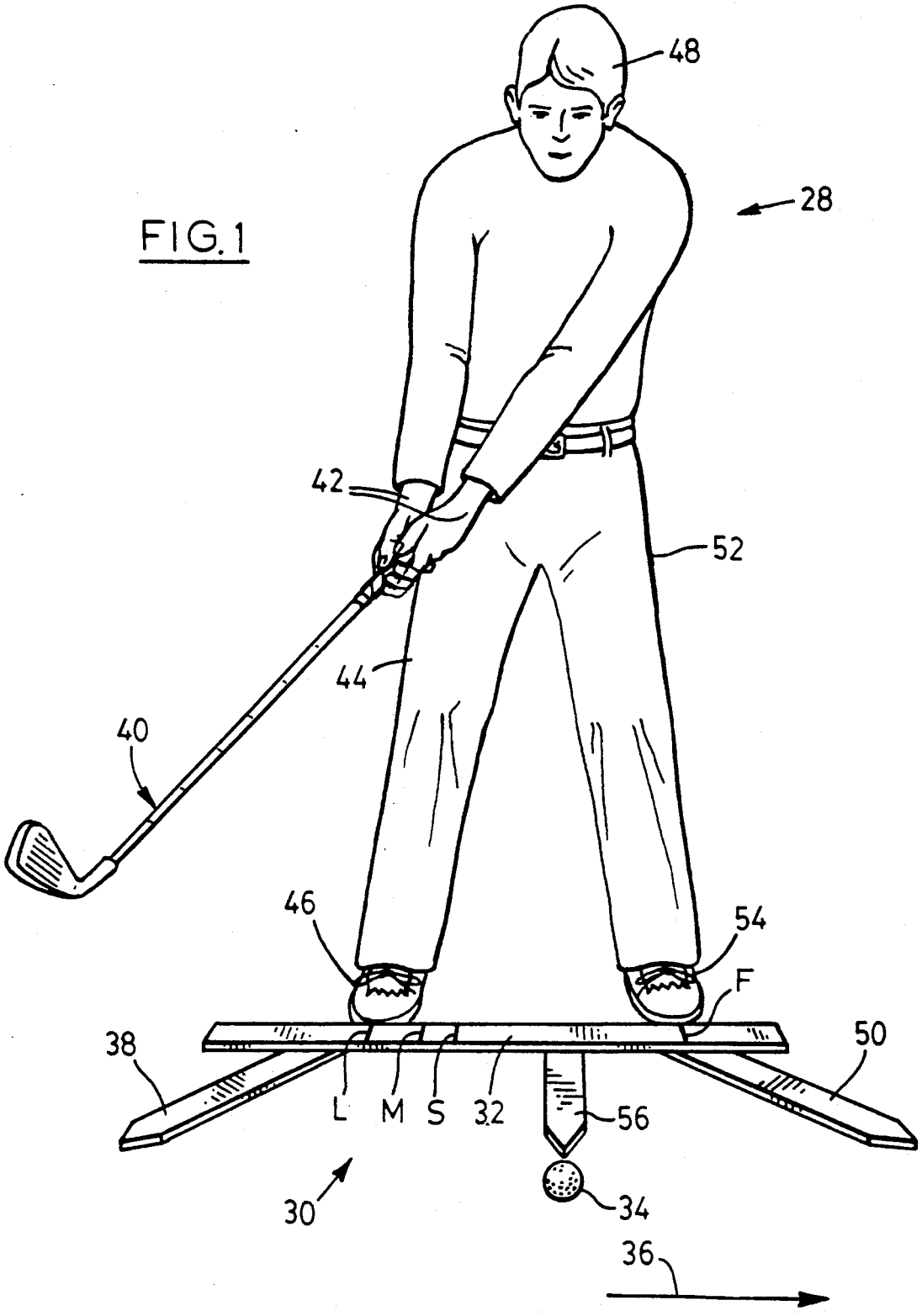
FIG. 1 is a simplified perspective view showing a golf training device according to the invention, being used by a golfer.

Referring to the drawings FIG. 1 shows a golfer 28 using a training device represented generally by the the numeral 30. The training device 30 has a base 32 with markings which indicate proper foot positions relative to a ball 34 and a target along arrow 36.

A backswing guide member 38 is connected to the base 32 and points in the direction the golfer's club 40 should point at a stage in the backswing where the wrists 42 are passing in front of the thigh 44 furthest from the target 36 and the weight of the body is shifting to the inside of the back foot 46.

Learning this stage of the backswing, among other benefits, leads to proper cocking of the wrists 42 as the club 40 is raised over the head 48 of the golfer 28.

A follow-through guide member 50 is connected to the base 32 to show the golfer 28 the proper position of the club 40 at a stage of the follow-through swing where the wrists 42 are passing in front of the thigh 52 closest to the target 36. The club 40 has passed the ball position and the weight of the body is on the front foot 54.

Figure 2:
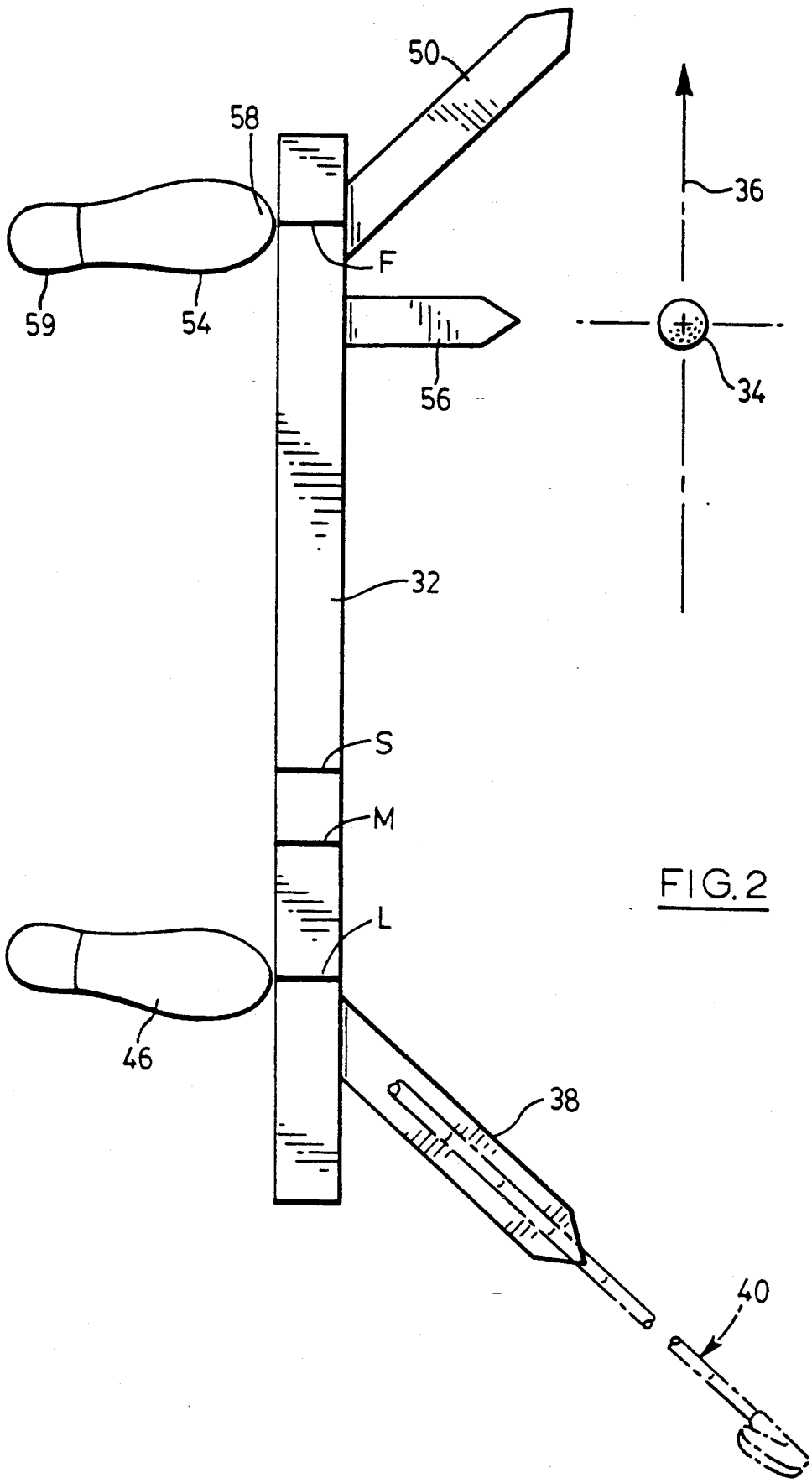
FIG. 2 is a schematic top view of the device of FIG. 1 showing club guide members.

FIGS. 1 and 2 show the markings to position the feet 46, 54 relative to the ball 34. The base 32 is aligned parallel to the target line 36 and has a pointer 56 for locating the ball 34. A front marking F is marked on the base 32 just ahead of the pointer 56 so when the toes 58 are at the marking F, the inside edge of the heel 59 is about 1" forward of the ball as is common practice.

Three rear foot markings are also provided on the base 32, namely S, the foremost marking used for short irons, and M and L, used for medium and long irons respectively.

As illustrated in FIG. 2, the golfer has positioned the club 40 (shown in ghost outline) along the backswing guide member 38 to the proper position as previously described.

Figure 3:
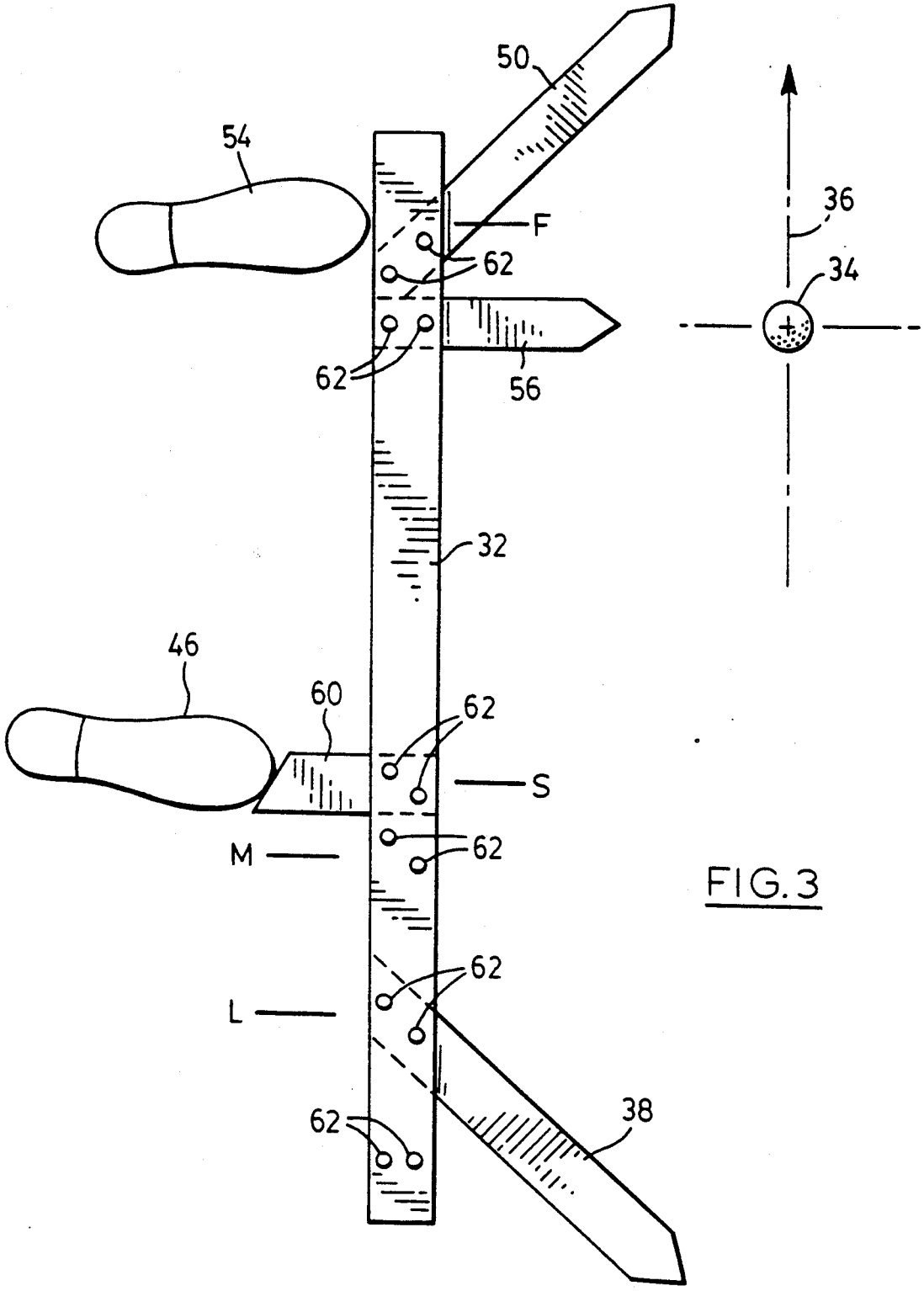
FIG. 3 is a view similar to FIG. 2 further showing a reversible foot offset member for fade and draw golf shots.

FIG. 3 shows a foot offset member 60 connected to the base 32 for positioning the rear foot 46 back from the target line 36 s the golfer is in a closed stance. This will produce a hook or draw in the golf shot. The foot offset number 60 can be turned over and attached to the base at position F corresponding to the front foot marking. In this position (not shown), the front foot 54 is moved back from the target line 36 and the rear foot is moved up to its original position at marking S, M or L. This is an open golf stance and will produce a slice or a fade.

FIG. 3 also schematically shows in top view the location of dowels 62 carried by the base 32 and used to releasably connect various parts of the device 30 to the base 32 as will be described. In the preferred embodiment, the guide members 38, 50, the pointer 56 and the foot offset member 60 have holes corresponding to the positions of dowels 62 on the base 32. Consequently, these parts can be snapped upwardly onto the dowels 62 underneath the base 32 as shown in FIG. 4 by movement in the direction of chained dotted lines 64.

In FIG. 4, the dowels 62 are positioned to snap into holes 66 in the foot offset member 60. The other members of the device 30 are attached to the base 32 in a similar fashion.

A further member attachable to the base 32 is shown in FIG. 5. Foot tilting menber 70 is attached to the base 32 at the M position but can be located at the S or the L position instead, snapping on to the dowels 62 in each position.

Figure 6:
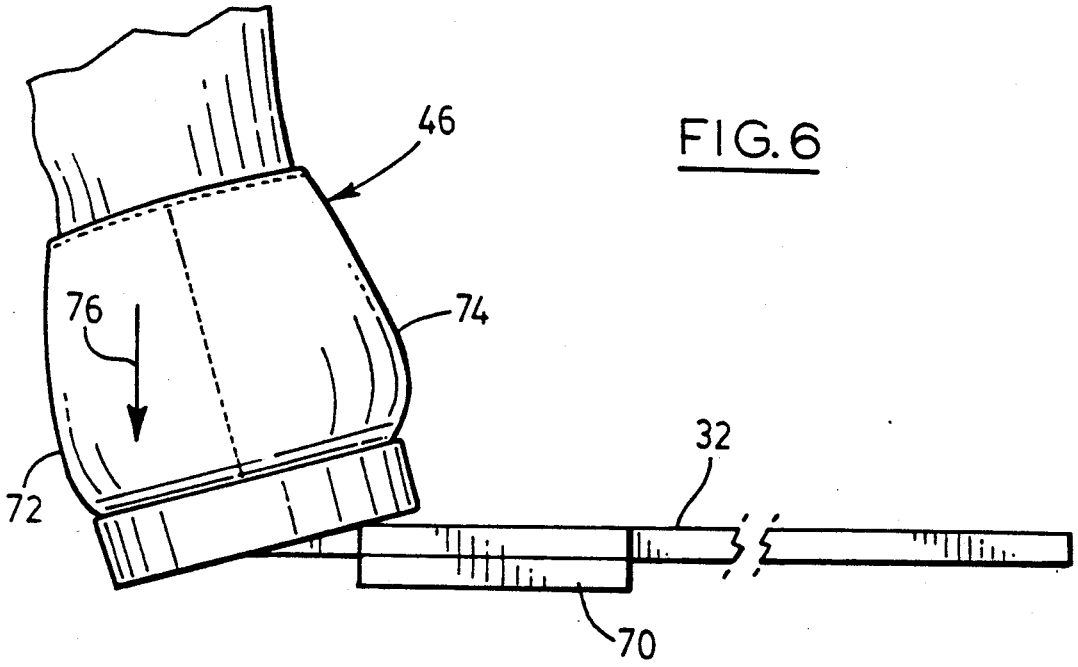
FIG. 6 is a side view of the foot tilting member showing foot position relative thereto.
Figure 7:
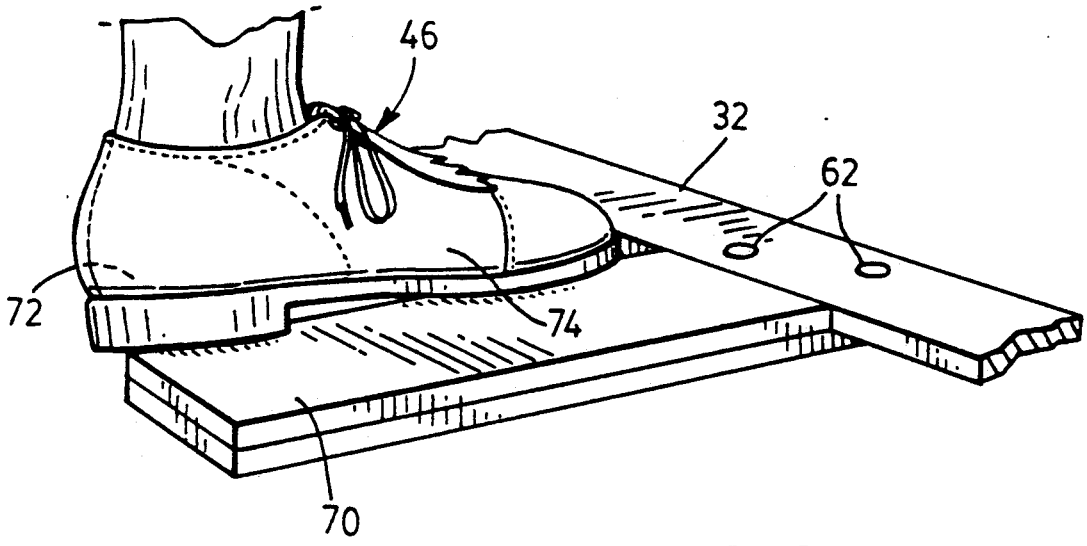
FIG. 7 is a simplified perspective view of the foot tilting member showing foot position relative thereto.

The purpose of the foot tilting member 70 will be explained with reference to FIGS. 6 and 7. When golfing, during the backswing, the body weight is transferred to the back foot 46. This weight should be received only by the inside 72 of the back foot 46. To help teach this feeling, the foot tilting member 70 is provided. This lifts the outside 74 of the foot 46 during this swing to force the weight along arrow 76 on the inside 72 of the foot 46.

Figure 8:
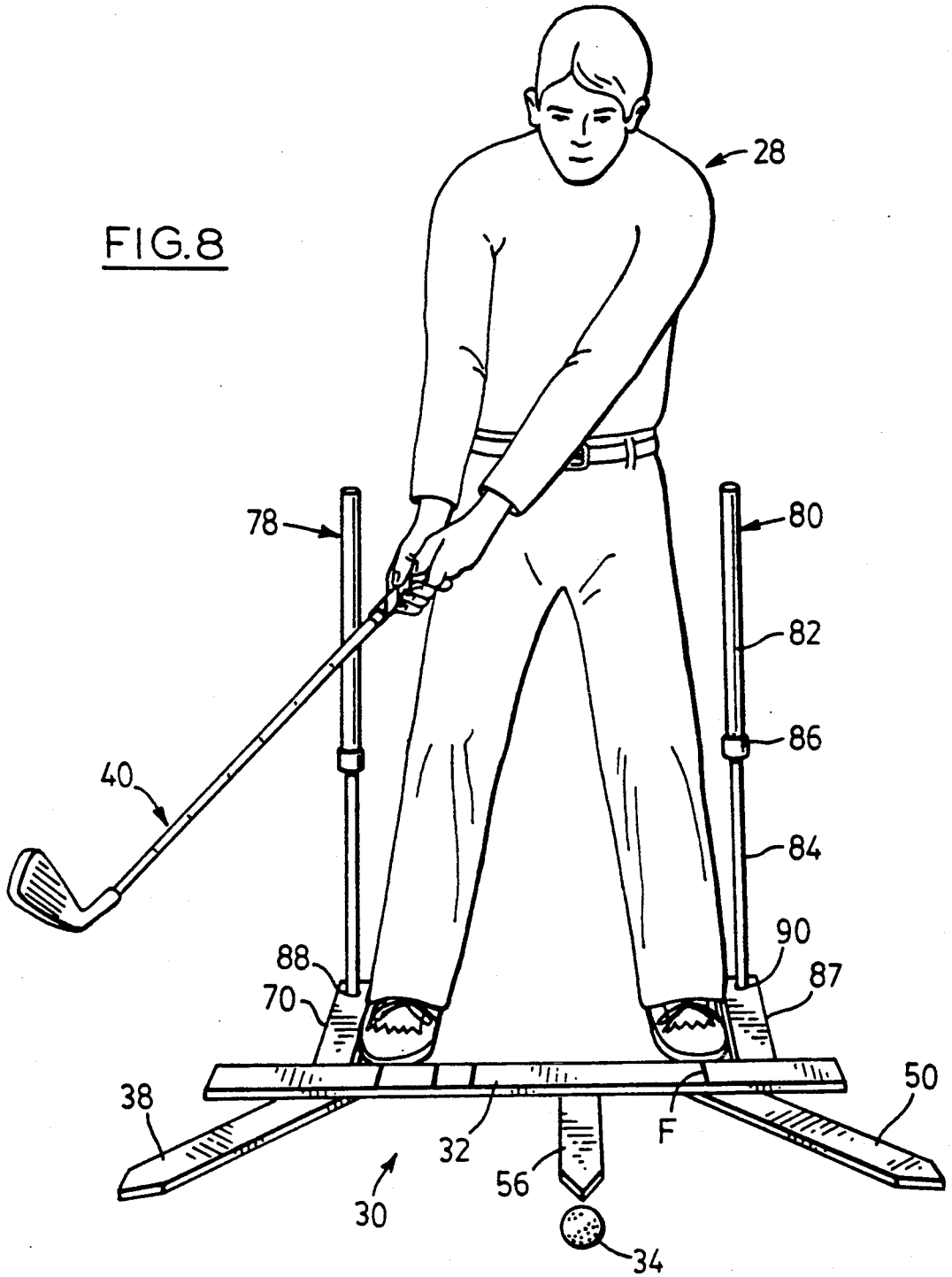
FIG. 8 is a simplified perspective view showing hip guides of the device.

FIG. 8 shows hip guides 78 and 80 which in the preferred embodiment are clear plastic rods of about 0.8 cm to about 1.2 cm in diameter. When the golfer 28 swings and the weight of the body transfers from foot to foot, the hips must stay within the guides 78, 80 to maintain proper balance.

Each hip guide is made from two rod sections, for example section 82, 84 of hip guide 80. These are joined at a bushing 86 which is permanently fastened to section 84. The guide 78 inserts into hole 88, at the end of the foot tilting member 70, the position of which is also shown in FIG. 5. The guide 80 inserts into an additional piece 87, similar to the foot tilting member 70 and snapped into dowels 62 at the front foot marking F shown in FIG. 5. Further bushings (not shown) can be sunk in the foot tilting member 70 and the additional piece 87 around the holes 88, 90 to strengthen the arrangement.

Figure 9:
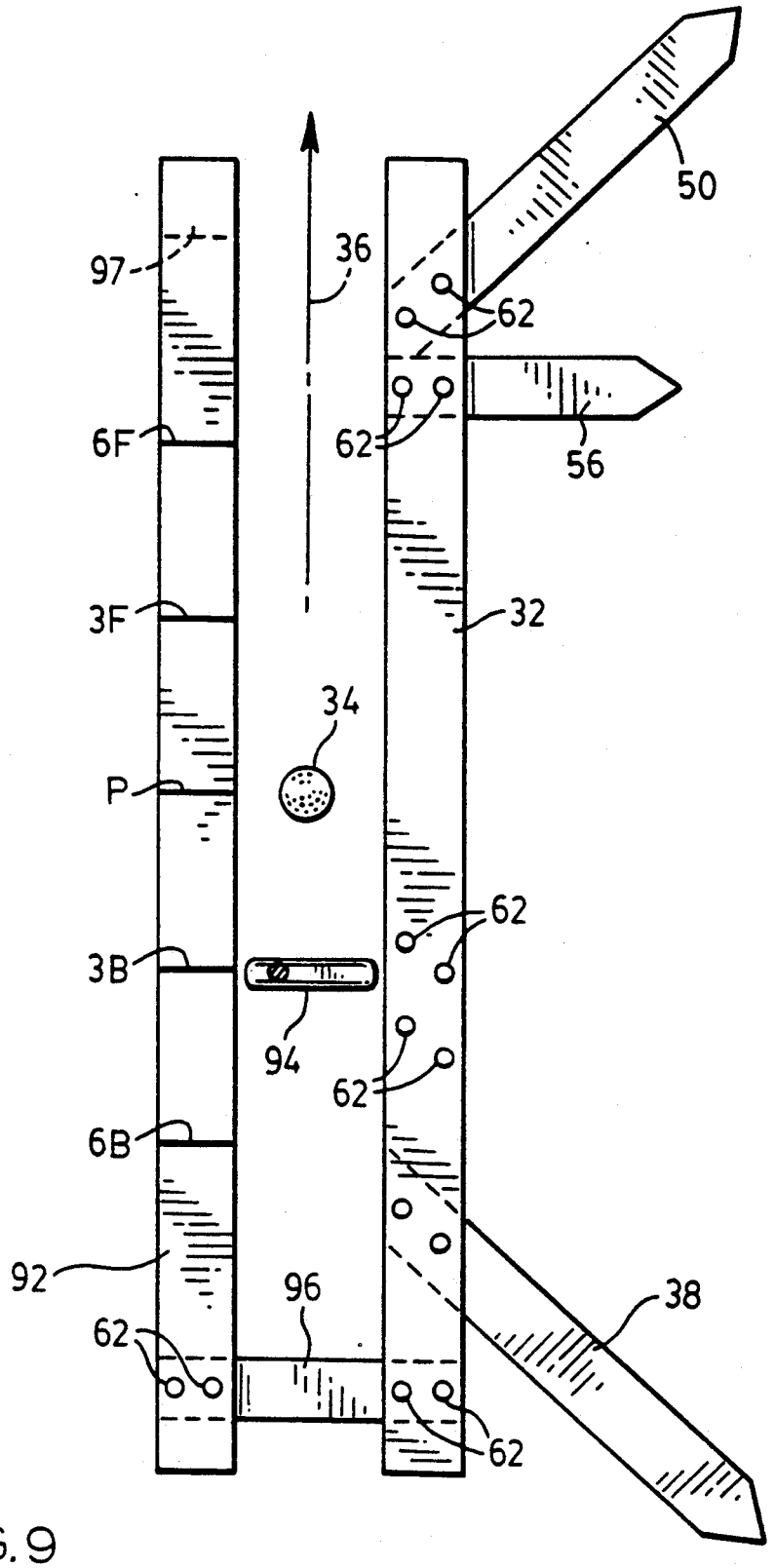
FIG. 9 is a view similar to FIG. 2 further showing a putting rail for teaching proper putting stroke.

In FIG. 9, a putting rail 92 is provided to provide a guide for a putter head 94 when putting the ball 34 along target line 36. Muscle memory is taught to keep the swing of the putter head 94 along the target line 36 and correct stroke lengths are marked on the rail 92. For a three foot putt (91 cm), assuming a flat putting surface, the putter head 94 is brought back to marking 3B approximately 3 inches (7.6 cm) back from the ball 34. The putting head 94 swings through the ball position P, to marking 3F at approximately 3 inches (7.6 cm) in front of the ball 34. Similar comments apply to a 6 foot (182 cm) putt using markings 6B and 6F. The rail 92 is connected to the base 32 with connecting member 96 using the dowel 62 technique as previously described. More dowels 62 can be used at this location to make the connecting member 96 adjustable when provided with appropriate holes. This will provide for a greater range of sizes in putter heads. The forward end of the putting rail 92 has a lift 97 equal in height to connecting member 96. The lift 97 is secured under the putting rail 92 to keep the putting rail 92 substantially paralled to the ground.

The invention has been described with respect to a right handed golfer. It will be apparent that for a left handed golfer, the device can be turned over and marking provided to afford the same benefits.

The parts of the described embodiments can be made from 0.5 cm thick, 5 cm wide plexiglass. The base 32 and the putting rail 92 can be about 36 cm long and be spaced apart about 10 cm by the connecting member 96 to allow for the length of a conventional putter head. The follow-through guide member 50 is at an angle of approximately 40 degrees to the base 32 open to the target 36. At the base 32, the rear edge of member 50 is about 5 cm back from the front foot marking F. The rear foot marking L is located at an average shoulder width back from the front foot marking F (about 40 cm). At the base 32 the front edge of the backswing guide member 38 is located substantially at the rear foot marking L. The guide member 38 angles at approximately 40 degrees facing away from the target 36. The other two rear foot markings M and S are typically 11 cm and 16 cm respectively ahead of the marking L. The markings may be painted or inlayed or provided in any other suitable manner a brief description of their purpose such as long, medium, short, ball, etc. Centre lines may be provided on the guide members 38, 50 to further emphasize the desired direction of the club 40. The lift 97 may be a piece of plexiglass fastened, for example by gluing to the putting rail 92.

It will be apparent that length and width of the parts of the device, including the hip guide sections 82, 84, are within the length and the width of the base 32 and therefore can be stacked or collected neatly and stored in an elongated carrying bag. Plexiglass provides a durable, lightweight, flexible unit which can be easily assembled. The weight of the device however is sufficient to lie flat on a grass surface.

Other embodiments of the invention will be readily apparent to a person skilled in the art, the scope of the invention being defined in the appended claims.

I claim:

1. A kit for training a golfer to obtain a proper swing, the kit comprising:

a base positionable on the ground and having markings to locate the feet and ball in correct relation to a target line to a target; and a backswing guide member, means for securing said guide member to the base at a fixed angle thereto to indicate the direction a golf club should be pointing during a first step of a correct backswing when the golfer's wrists are substantially adjacent the leg furthest from the target, said direction indicated by the backswing guide member being at an angle of approximately 40° to the target line facing away from the target.

2. A kit as claimed in claim 1 and further comprising a follow-through guide member securable to the base at a fixed angle thereto to indicate the direction a golf club should be pointing during a first step of a correct follow-through swing when the golfer's wrists are substantially adjacent the leg closest to the target, said direction indicated by the follow-through guide member being at an angle of approximately 40° to the target line facing the target.

3. A kit as claimed in claim 1 wherein the backswing guide member lies substantially flat on the ground.

4. A kit as claimed in claim 1 wherein the base has markings to locate the feet when using a range of different golf clubs.

5. A kit as claimed in claim 1 wherein the base has markings to locate the feet for a fade or a draw golf shot.

6. A kit as claimed in claim 5 wherein the marking to locate the feet for a fade or a draw is a foot guide securable to the base in a first position to cause a fade or in a second position to cause a draw golf shot.

7. A kit as claimed in claim 1 also including a foot tilting member securable to said base at a position to lift the outside of the foot of said leg furthest from the target.

8. A kit as claimed in claim 1 also including hip positioners which extend substantially perpendicular to the ground to indicate the permissible range of hip movement during a proper swing.

9. A kit as claimed in claim 8 wherein said hip positioners are rods having a diameter of from about 0.8 cm to about 1.2 cm.

10. A kit as claimed in claim 1 further comprising a putting track member for guiding a putter head to stroke substantially towards the target.

11. A kit as claimed in claim 10 wherein said putting track member has markings to indicate proper back swing and follow through of the putter.

12. A kit as claimed in claim 1 wherein the kit is made from modular pieces which connect together.

13. A kit as claimed in claim 12 wherein the modular pieces snap together.

14. A kit as claimed in claim 12 wherein the modular pieces are of plexiglass.

15. A kit as claimed in claim 12 wherein the modular pieces are stackable on one another to fit in an elongated case.

16. A device for training a golfer to obtain a proper swing, the device comprising:

a base positionable on the ground and having markings to locate the feet and ball in correct relation to a target line to a target; and a backswing guide member connected to the base at a fixed angle thereto to indicate the direction a golf club should be pointing during a first step of a correct backswing when the golfer's wrists are substantially adjacent the leg furthest from the target, said direction indicated by the backswing guide member being at an angle of approximately 40° to the target line facing away from the target.

17. A device as claimed in claim 16 further comprising a follow-through guide member connected to the base at a fixed angle thereto to indicate the direction a golf club should be pointing during a first step of a correct follow-through swing when the golfer's wrists are substantially adjacent the leg closest to the target, said direction indicated by the follow-through guide member being at an angle of approximately 40° to the target line facing the target.

18. A device as claimed in claim 16 wherein the backswing guide member and the follow-through guide member lie substantially flat on the ground.

19. A method of learning a proper golf swing comprising the steps:

placing on the ground a device having markings to locate the feet relative to a golf ball and target and a backswing guide member to indicate the direction a golf club should be pointed during a first step of a correct backswing when the golfer's wrists are substantially adjacent the leg furthest from the target, said direction indicated by the backswing guide member being at an angle of approximately 40° to the target line facing away from the target.

positioning the feet at said markings;

carrying out the first step of a backswing by raising the club to a position with the hands substantially at said leg furthest from the target;

aiming the club substantially along said backswing guide member; and continuing the backswing.

20. A method as claimed in claim 19 wherein said device also has a follow-through guide member to indicate the direction a golf club should be pointing during a first step of a correct follow-through swing when the golfer's wrists are substantially adjacent the leg closest to the target, said direction indicated by the follow-through guide member being at an angle of approximately 40° to the target line facing the target and the method further comprises the steps of;

completing the downswing through the ball position;

raising the club a position with the hands substantially at the leg closest to the target;

aiming the club substantially along said follow-through guide member;

and continuing the follow-through swing.

* * * * *